US007861323B2

(12) United States Patent
Inagaki et al.

(10) Patent No.: US 7,861,323 B2
(45) Date of Patent: Jan. 4, 2011

(54) LOWER TORSO PANTS GARMENT

(75) Inventors: Muneharu Inagaki, Toyama (JP); Ikuo Toratani, Kahoku (JP)

(73) Assignees: Toratani Kabushiki Kaisha, Ishikawa (JP); Goldwin Technical Center Inc., Toyama (JP)

( * ) Notice: Subject to any disclaimer, the term of this patent is extended or adjusted under 35 U.S.C. 154(b) by 167 days.

(21) Appl. No.: 11/990,752

(22) PCT Filed: Aug. 22, 2005

(86) PCT No.: PCT/JP2005/015219

§ 371 (c)(1),
(2), (4) Date: Jul. 1, 2008

(87) PCT Pub. No.: WO2007/023518

PCT Pub. Date: Mar. 1, 2007

(65) Prior Publication Data

US 2009/0133182 A1 May 28, 2009

(51) Int. Cl.
*A41D 1/06* (2006.01)
*A41D 13/02* (2006.01)

(52) U.S. Cl. ..... 2/227; 2/228; 2/238

(58) Field of Classification Search ..... 2/228, 2/69, 238, 227; 450/94, 100, 101, 106, 107, 450/112, 132

See application file for complete search history.

(56) References Cited

U.S. PATENT DOCUMENTS

| | | | | |
|---|---|---|---|---|
| 3,323,140 | A * | 6/1967 | Morris | 2/227 |
| 4,625,336 | A * | 12/1986 | Derderian | 2/79 |
| 4,875,240 | A * | 10/1989 | Barrett | 2/227 |
| 4,989,272 | A * | 2/1991 | Wagner | 2/227 |
| 5,136,727 | A * | 8/1992 | Brisco | 2/409 |
| 5,182,815 | A * | 2/1993 | Young | 2/406 |
| 5,761,747 | A * | 6/1998 | Eagleson | 2/400 |
| 6,189,155 | B1 * | 2/2001 | Boulanger | 2/409 |

FOREIGN PATENT DOCUMENTS

| | | | |
|---|---|---|---|
| JP | 2003-49304 | A | 2/2003 |
| JP | 2003-89905 | A | 3/2003 |
| JP | 2003-293203 | A | 10/2003 |

* cited by examiner

*Primary Examiner*—Gloria Hale
(74) *Attorney, Agent, or Firm*—Kubovcik & Kubovcik

(57) ABSTRACT

Leg wear includes a front having leg opening forming portions, and a back connected to the front having leg opening forming portions continuing to the leg opening forming portions of the front. The leg wear further includes thigh portion parts connected to the leg opening forming portions of the front and back and formed into a cylindrical shape for inserting the thigh portions. The heights of the crests of the thigh portion parts are smaller than the curved depths of the leg opening forming portions, and the widths of the crests are made larger than those of the curved portions of the leg opening forming portions, so that the thigh portion parts having a cylindrical shape in the worn state are shaped to protrude forward relative to the front.

3 Claims, 7 Drawing Sheets

LOWER TORSO PANTS GARMENT

This application is a 371 of international application PCT/JP2005/015219 filed Aug. 22, 2005, which is incorporated herein by reference.

TECHNICAL FIELD

This invention relates to a lower torso pants garment such as underwear or sportswear, which are shaped to cover femoral region portions.

BACKGROUND ART

In most of conventional leggings which are commercially available, a lower waist portion and femoral region portions are connected to each other by one sheet of cloth, and its sportiness depends mostly on the stretchability of a material employed therefor. Among them, contrivances to overcome an obstacle to the mobility of the femoral region portions have been made only to an extent such that a highly stretchable material at the best.

In addition, the conventional leggings which allow wearers to have an excellent feel of wearing by sewing parts of predetermined shapes include a sportswear of Patent Document 1. This sportswear reliably supports the vicinities of the waist and the legs of the wearer, protects the muscles, and improves the athletic ability.

Patent Document 1: JP-A-2003-49304

DISCLOSURE OF THE INVENTION

Problems that the Invention is to Solve

Since the aforementioned leggings or the like, of the related art, has a basic pattern according to a standing position, it has been insufficient to follow the bending motion of hip joints by way of these individual contrivances. A shape of the leggings or the like, which is better fit for the motions of a body, has been desired especially in sports events in which athletes are often required to bend forward or to squat down while raising a leg to thereby widely bend and stretch the hip joints.

Moreover, in the leggings of the related art, the fabric at the buttock portions is stretched; and a tension is produced, and a pressure is applied thereto; a force is applied to the femoral region portions as well in a compressive direction; and in turn, a resistance of hampering a motion has been physically generated. There have also been proposed several products in which the leg hole portions are made separate and the lower waist portion and the femoral region portions as different parts are seamed together. However, these products are insufficient in stretchability or the motion followability. Likewise, the sportswear of Patent Document 1 fails to improve the motion followability at the time of bending and stretching the hip joints.

This invention has been made in view of the above-described problems of the related art, and aims to provide a lower torso pants garment, which is smooth in motions to bend and stretch the hip joints and is suitable for use in exercise.

Means for Solving the Problems

According to the present invention, there is provided a lower torso pants garment comprising: a front body portion having leg hole forming portions for curved leg holes, into which femoral region portions are inserted; a back body portion having leg hole forming portions and connected to the front body portion for covering buttock portions of a wearer and having leg hole forming portions continuing to the leg hole forming portions of the front body portion; and femoral region portion parts having a tubular shape and connected to individual leg hole forming portions of the front body portion and the back body portion for inserting the femoral region portions thereinto, in which: the leg hole forming portions of the front body portion include curved crests which are positioned near iliac spine points of the wearer whereas the leg hole forming portions of the back body portion include lower end edges which are positioned near the lower ends of the buttocks; the femoral region portion parts include crests that are smaller than curved depths of a front side of the leg hole forming portions; and widths of the crests are made larger than widths of the curved portions of the leg hole forming portions, so that the femoral region portion parts having a tubular shape when worn are shaped to protrude forward relative to the front body portion.

The back body portion includes a waist portion and a crotch portion and the front body portion includes a waist portion and a crotch portion and a length of the back body portion from the waist portion to the crotch portion is made larger than a length of the front body portion from the waist portion to the crotch portion, such that tension is not applied to the back body portion when the femoral region portions of the wearer are inserted into the femoral region portion parts and said femoral region portions are protruded forward relative to the front body portion.

The leg hole forming portions are shaped such that the hip hem lines are enveloped by the curved leg hole portions from the vicinities of the trochanters of the body of the wearer through the vicinities of iliac spines points of the wearer to the vicinities of the crotch and by curves bulging from the vicinities of the trochanters to the sides of the crotch, and such that the leg hole forming portions contact closely with the hip hem portions.

The femoral region portion parts are formed of a single fabric having two side portions and hem portions and the two side edge portions are folded back at the hem portions and connected in a laminated state over the leg hole forming portions of the front body portion and the leg hole forming portion of the back body portion, and in that overlapped fabrics of the femoral region portion parts are made slidable relative to each other.

Advantage of the Invention

The lower torso pants garment of the present invention is formed in the three-dimensional shape along the position of bent femoral region portions, and is less stretchable in the fabric relative to the bending and stretching motions of the hip joints, so that the exercise can be taken in the state in which a low tension is applied to the fabric. As a result, the resistance exerted by the fabric is so low at the time of bending and stretching motions that a wearer can enjoy smooth exercise while lessening a burden upon the body.

DESCRIPTION OF REFERENCE NUMERALS AND SIGNS

10 Leggings
12 Front Body Portion
14 Back Body Portion
16 Crotch Portion Part
18 Femoral Region Portion Parts
20, 28 Waist Portion
24, 25, 32, 46 Leg Hole Forming Portions
36 Hem Portion
40 Footed Root Portion
40*a* Crest

BEST MODE FOR CARRYING OUT THE INVENTION

Figure 1:
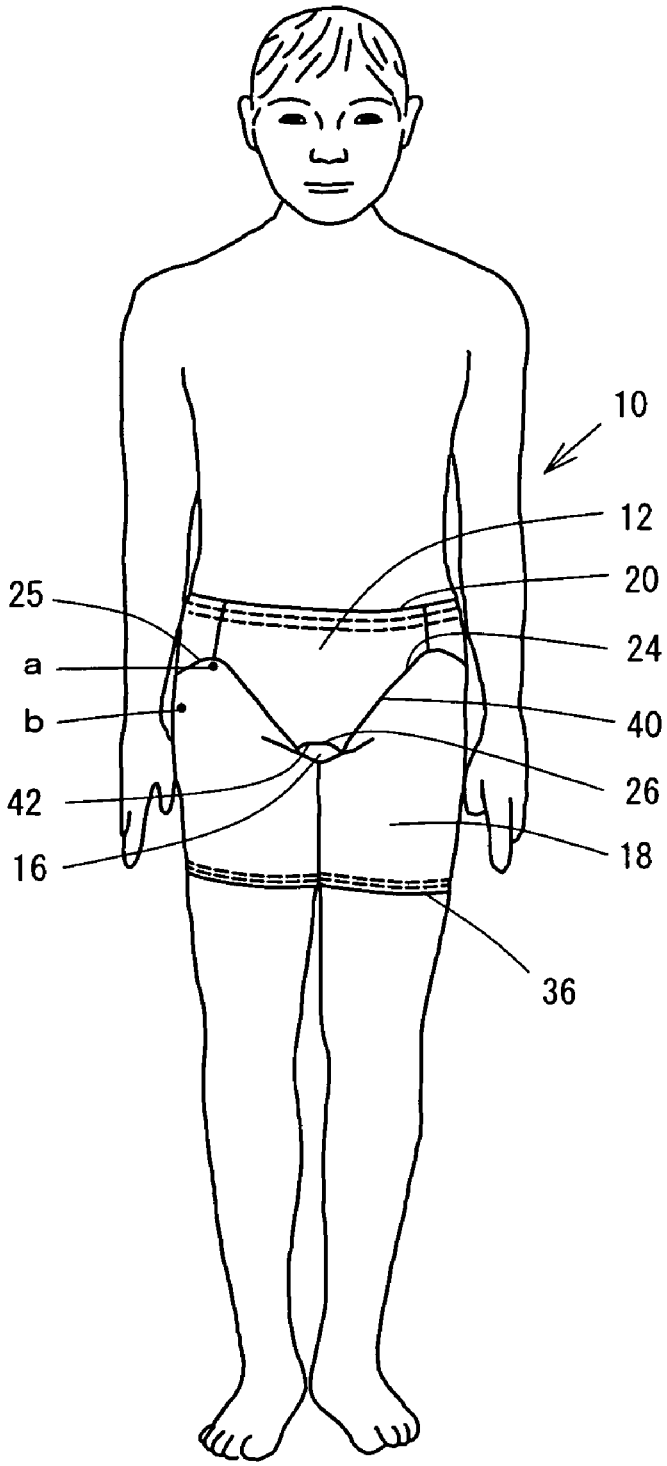
FIG. 1 is a front view of a lower torso pants garment according to an embodiment of this invention.
Figure 2:
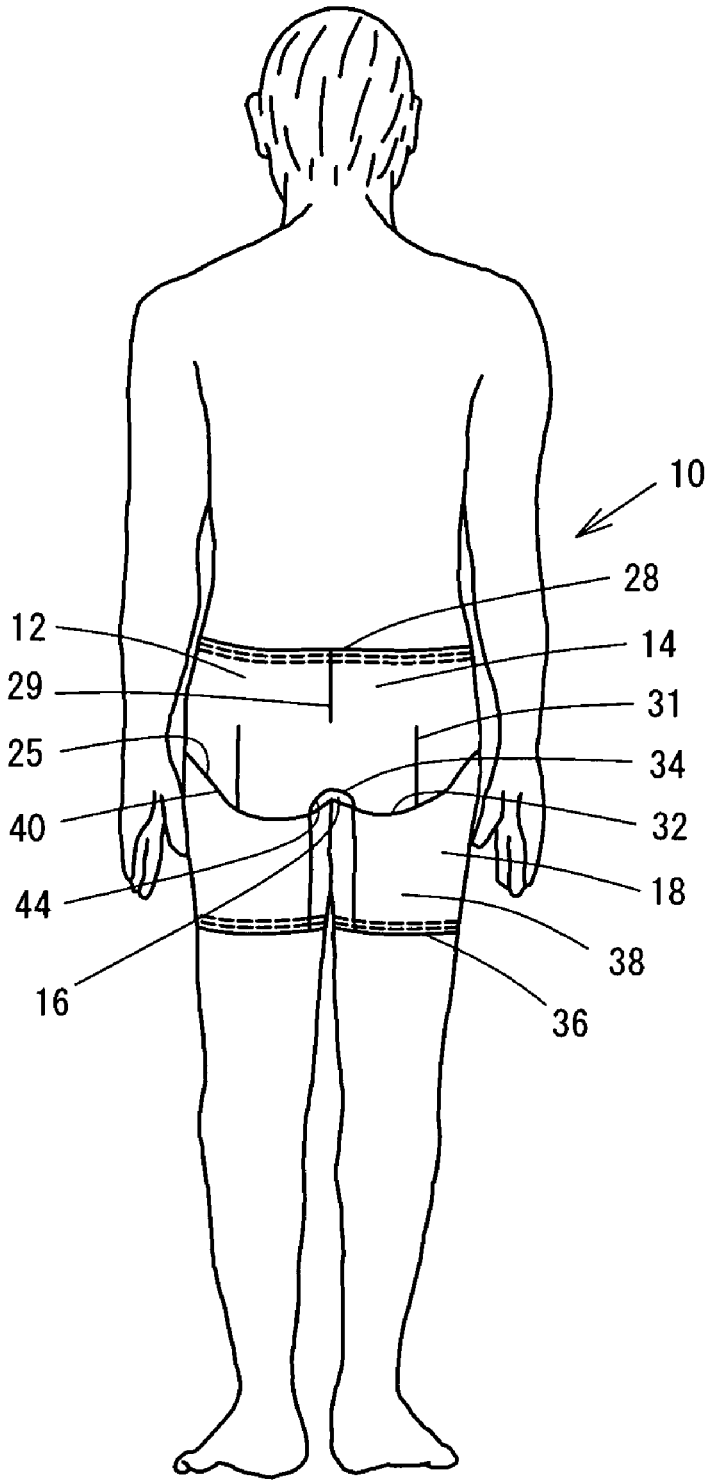
FIG. 2 is a back view of the lower torso pants garment according to the embodiment.

Hereinafter, an embodiment of this invention will be described with reference to the accompanying drawings. FIG. 1 and FIG. 2 show an embodiment of this invention. The lower torso pants garment of this embodiment is leggings 10 shaped like a short-pants, extending from the waist to the intermediate portions or its vicinity of the femoral region portions. The leggings 10 are made of a fabric such as a stretchable knitted fabric. The leggings 10 are comprised of a front body portion 12 for covering the lower waist portion from the front side to the two sides, a back body portion 14 for covering the back side of the lower waist portion, and a crotch portion part 16 for connecting the center of the lower end edge of the front body portion 12 and the center of the lower end edge of the back body portion 14. Moreover, a pair of femoral region portion parts 18 formed in such a tubular shape as to cover the femoral region portions are disposed in the holes which are formed by the front body portion 12, the back body portion 14 and the crotch portion part 16 so that the femoral region portions may be inserted the holes.

Figure 3:
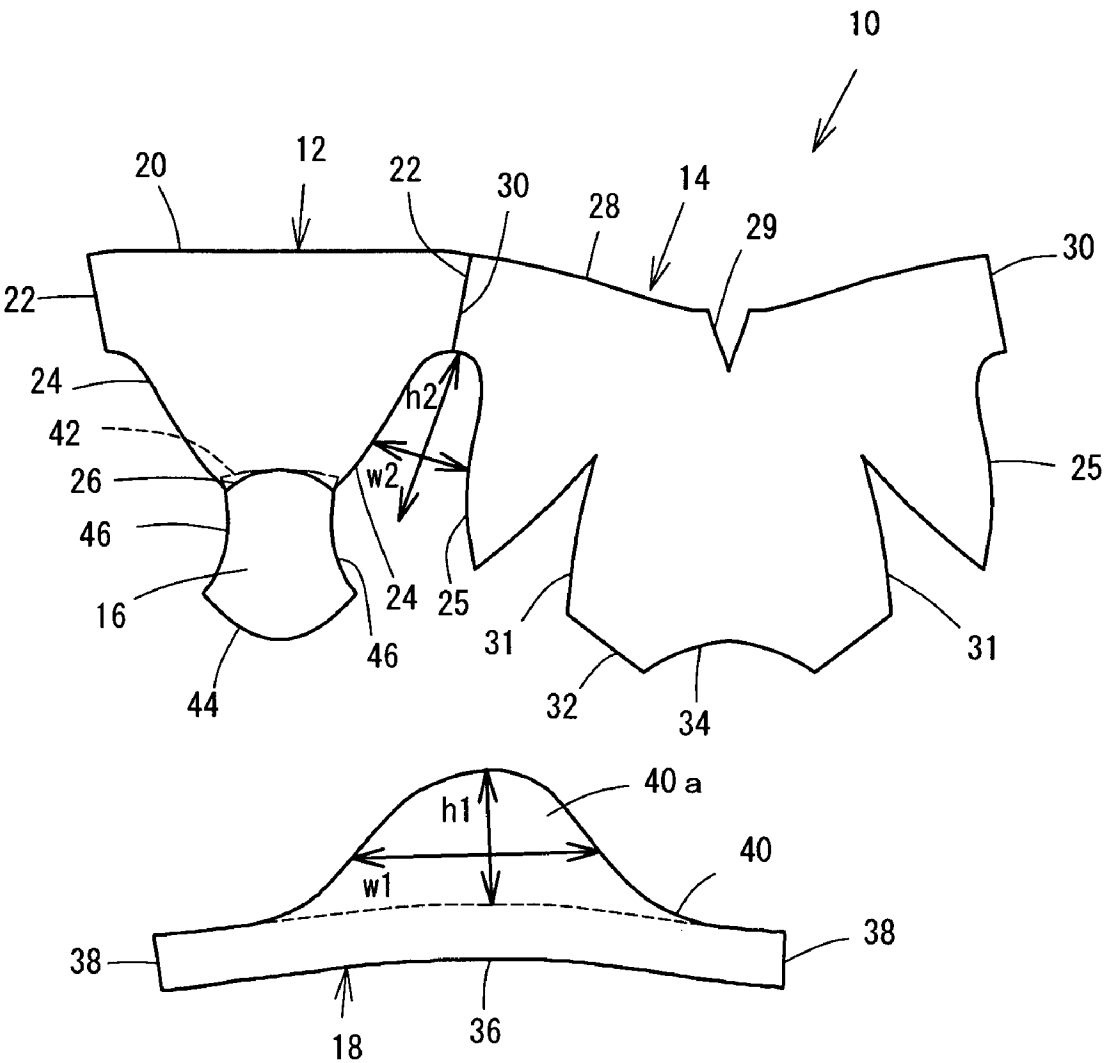
FIG. 3 is an exploded view of the individual parts of the hole embodiment.

The shapes of the individual parts are described bellow. FIG. 3 shows an exploded view of the leggings 10. The front body portion 12 includes a waist portion 20, and waist front side edges 22, a respective one of which is cut substantially at a right angles with respect to the waist portion 20 in proximity to the iliac spine points a at the femoral root on each side of the waist portion 20. On the body front center sides of the waist front side edges 22, leg hole forming portions 24 are individually provided for forming a pair of leg holes which are continuously cut from the lower end edges of the waist front side edges 22.

The leg holes serve as holes for inserting the femoral region portions thereinto when the leggings 10 are sewn. Leg hole forming portions 25 are also formed in the back body portion 14 from the side edges to the lower end edge, as described later. The paired leg hole forming portions 24 are formed to be inclined so that they are spaced from each other as they approach the waist portion 20 from the central position of the lower end edge of the front body portion 12. The edge portion between the paired leg hole forming portions 24 provides a front crotch portion 26, at which the crotch portion part 16 is connected and which is formed of a slightly upwardly inflectional curve.

At the back body portion 14, an waist portion 28 is provided as an edge portion which widely opens in a substantial V-shape; waist darts 29 cut into a V-shape are provided at the center of the waist portion 28; and substantially straight waist front side edges 30 are provided, a respective one of which extends in a direction spaced at a right angle with respect to the waist portion 28 from a respective one of the two ends of the waist portion 28. The waist front side edges 30 are equal to the waist front side edges 22 of the front body portion in length, and widen to be slightly spaced from each other, as they are spaced from the waist portion 28.

The leg hole forming portions 25, which are oriented toward the lower end of the back body portion 14, are formed at the lower ends of the waist front side edges 30, and buttock darts 31 cut in a V-shape are provided on the body center side ends of the leg hole forming portions 25. A pair of leg hole forming portions 32 are formed on the body center side ends of the buttock darts 31. The leg hole forming portions 32 are adapted to form the holes through which the femoral region portions are continuously inserted into the leg hole forming portions 24 of the front body portion 12 when the leggings 10 are sewn.

A back crotch portion 34 to which the crotch portion part 16 is connected is between the paired leg hole forming portions 32, and is formed in a slightly upwardly inflectional curve. Moreover, the length from the waist portion 28 of the back body portion 14 to the back crotch portion 34 is defined to be greater than that from the waist portion 20 of the front body portion 12 to the front crotch portion 26. The leg holes, which are formed of the leg hole forming portions 24 and 25, are formed in such substantially triangular shapes having apexes located at the positions closest to the waist portion 20. These apexes located thereat are provided so that they are roundly curved.

At the femoral region portion part 18, a hem portion 36 formed of a slightly inwardly inflectional curve is provided, and substantially straight, femoral back side edges 38 are formed, a respective one of which extends in a direction which is spaced from a respective one of the two end portions of the hem portion 36 substantially at a right angle with respect to the hem portion 36. A footed root portion 40 in which a crest 40*a* gently bulging to the outer side is formed is provided at the edge portion that is opposite to the hem portion 36, between the femoral back side edges 38. When the leggings 10 are sewn, the footed root portion 40 is sewn with the leg hole forming portions 24 of the front body portion 12 and the leg hole forming portions 25 and 32 of the back body portion 14, and the crotch portion part 16 is also sewn with the hole which is continuously formed by leg hole forming portions 46. The edge portion of the crest 40*a* of the footed root portion 40 is formed to have a length which is equal to that of the leg hole forming portions 24 of the front body portion 12, and is sewn with the leg hole forming portions 24. If the height of the crest 40*a* of the footed root portion 40 to be attached to the leg hole forming portions 24 and 25 is designated by h1; and if the curved depth of the leg hole forming portions 24 and 25 is designated by h2, the depth h1 is smaller than the depth h2. If the width of the crest of the footed root portion 40 is designated by w1; and if the width of the curved portions of the leg hole front portions 24 and 25 is designated by w2, the width w1 is greater than the width w2 at the same positions to be sewn with each other.

The crotch portion part 16 is formed in such a substantial hand drum shape as to be elongated in one direction in which one longitudinal end portion thereof is a front body portion's connection portion 42 to be connected to the front body portion 12, whereas the other longitudinal end portion thereof is a back body portion's connection portion 44 to be connected to the back body portion 14. Both of these connected portions are formed of bulging curves. The two longitudinal side edge portions of the crotch portion part 16 are the leg hole forming portions 46 which are connected to the femoral region portion parts 18 so as to form portions of the foot holes and which are formed of inward curves. The crotch portion part 16 is formed to be wider, with the leg hole forming portions 46 being gradually spaced from each other, as the crotch portion part 16 approaches the back body portion's connection portion 44, so that the back body portion's connection portion 44 may be longer than the front body portion's connection portion 42.

Moreover, the length of a pattern of the leg hole forming portions 25 and 32 of the back body portion 14 and the leg hole forming portions 46 of the crotch portion part 16 to the crotch, i.e., the groin point is smaller than the length in the body length from trochanters b through the hip hem lines until the sides of the groin point are reached.

In the method for manufacturing the leggings 10, of this embodiment, first, the right and left buttock darts 31 and the waist darts 29 are sewn together. Next, the front body portion's connection portion 42 of the crotch portion part 16 is attached to the front crotch portion 26 of the front body portion 12. The right and left waist front side edges 22 and the waist front side edges 30 of the front body portion 12 and the back body portion 14 are sewn together. The footed root portion 40 of the femoral region portion parts 18 is then sewn up with the individual leg hole forming portions 24, 25, 32 and 46 which are connected in series. At this time, an angle portion formed between the femoral back side edge 38 and the footed root portion 40 of one of the femoral region portion parts 18 is positioned at the angle portion formed between the back body portion's connection portion 44 and the leg hole forming portions 46 of the crotch portion part 16 that is already attached to the front body portion 12. On the other hand, the angle portion formed between the femoral back side edge 38 and the footed root portion 40 of the other femoral region portion part 18 is positioned at the angle portion formed between the back crotch portion 34 and a respective one of the leg hole forming portions 32 of the back body portion.

Next, the femoral backside edges 38 of one of the femoral region portion part 18 are sewn with each other. Subsequently, the back crotch portion 34 of the back body portion 14 and the back body portion's connection portion 44 of the crotch portion part 16 are sewn with each other. Still subsequently, the femoral backside edges 38 of the other femoral region portion part 18 are sewn with each other. Finally, the waist portions 20 and 28 and the hem portions 36 are subjected to finishing treatments and hemming treatments. The sewing orders can be appropriately changed without being imitative thereto.

The leggings 10 thus sewn up are formed in a three-dimensional shape in which the leg hole forming portions 32 of the back body portion 14 extend round downward so that the femoral region portion parts 18, which are formed in a tubular shape, protrude obliquely forward and downward. In brief, the basic three-dimensional shape of the leggings is formed along a posture at which a wearer slightly slouches, and is formed in a shape suitable for foot mobility.

When the wearer wears sewn leggings 10 on the legs, the leg hole forming portions 24 of the front body portion 12 extend upward from the sides of the crotch, i.e. , the groin point and pass through the vicinity of the iliac spine points a of the femoral roots of the legs. Then, these portions pass and curve upward of the vicinity of the trochanters b at the upward outside of the femoral region portion and then extend downward to the back side. Further, they are continuous to the leg hole forming portions 32 of the back body portion 14. The leg hole forming portions 32 of the back body portion 14 reach the vicinity of the crotch, i.e., the groin point along the lower end edges of the buttock portions. The highest positions of the leg hole forming portions 24 are located near the iliac spines points a. Moreover, the seams of the buttock darts 31 are located slightly sideways of the highest positions of the buttock portions as to pass vertically.

Figure 4:
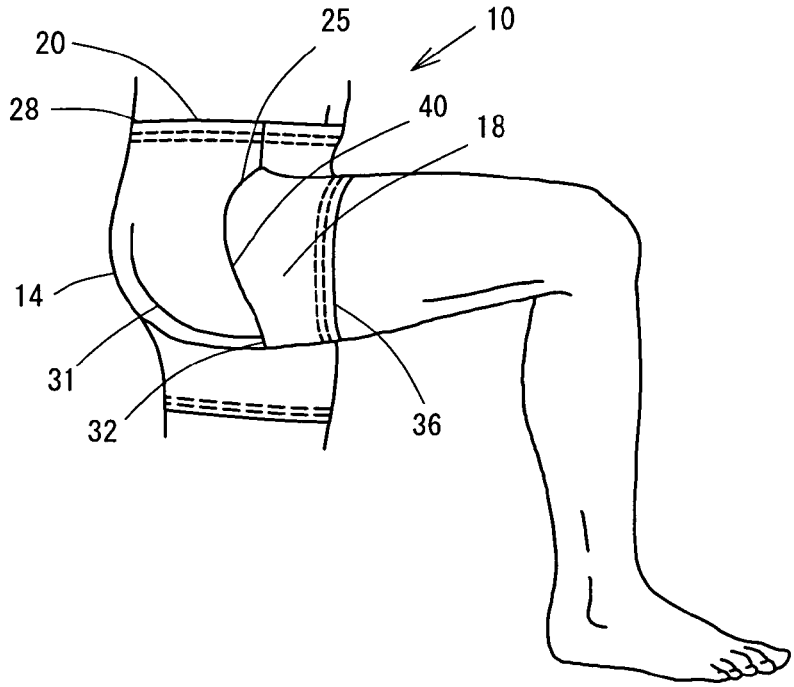
FIG. 4 is a right side view showing a state of the lower torso pants garment in use according to the embodiment.
Figure 5:
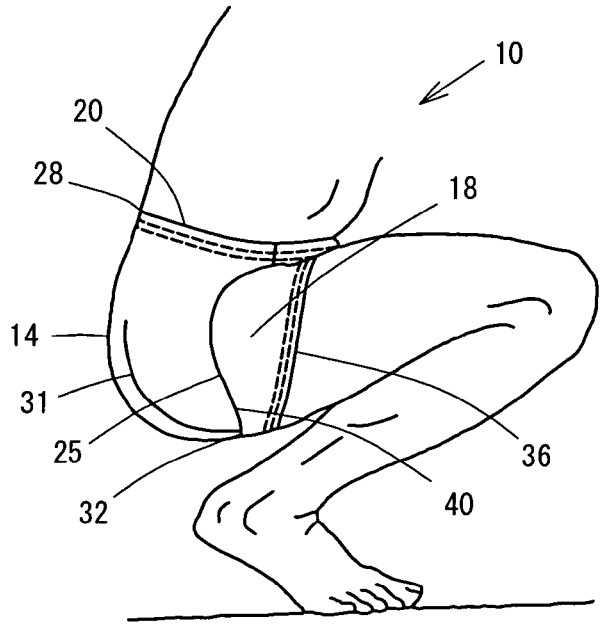
FIG. 5 is a right side view showing another state of the lower torso pants garment in use according to the embodiment.

According to the leggings 10 of this embodiment, the stretchable material is used to assure the quantity of fabric for the buttock portions, and the shape of the leg hole pattern is contrived to assure the tree-dimensional directivity of the fabric forward of the vicinities of the iliac spine points a of the body, so that the wearer can receive less bending forward resistances at the hip joints and can work out well with less fatigues. In other words, in connection with the buttock portions, the quantity of fabric is sufficiently assured to an extent such that any excessive fabric tensile stress is disallowed to be applied to the buttock portions at the time of bending the hip joint, and the hip hem lines are shortened so as to hold the hip hem lines. Especially, the leggings 10 are formed in such a three-dimensional shape as are taken along a posture at which the wearer slightly slouches. At this posture, the fabric does not develop a high tension so that it does not compress the body. Moreover, the leggins 10 can lessen a load applied when the wearer takes a motion to bend more deeply. Moreover, the femoral region portion parts 18 are formed in a three-dimensional shape in which they bulge forward. When the wearer raises a leg or squats down, as shown in FIG. 4 and FIG. 5, the fabric can exert a less resistance to the femoral region portions so that the wearer can take exercise easily. Moreover, the fabric follows motions of the body so that it can reduce friction in cloth. Moreover, the back body portion 14 is defined to be vertically longer than the front body portion 12 so that no heavy tension is applied to the back body portion 14 when the wearer raises a leg or squats down, as shown in FIG. 4 and FIG. 5. This enables the wearer to take smooth exercise without any slip-up of the back body portion 14.

In addition, the seams of the buttock darts 31 pass through the positions which are shifted slightly sideways from the highest positions of the buttock portions so that they can provide the quantity of fabric, which is sufficient in following the motions of the buttock portions in the bending and stretching exercises. Moreover, the seams are lesser stretchable than the surrounding fabric, so that they can eliminate discomfort which may be felt at the time of wearing.

Figure 6:
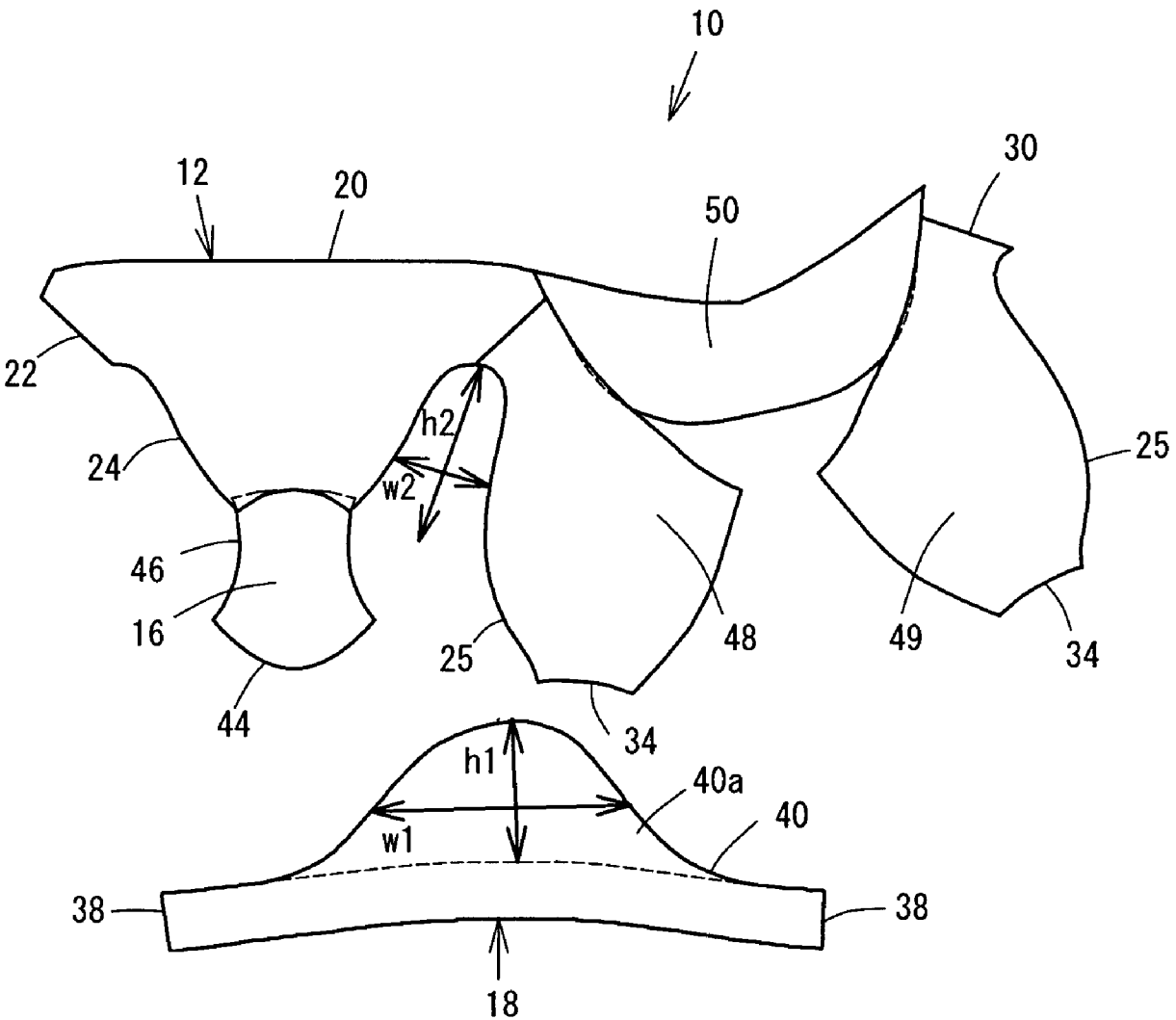
FIG. 6 is an exploded view of the individual parts of a lower torso pants garment according to another embodiment of this invention.

This invention may be modified to form the shapes of the individual parts, as shown in FIG. 6, without being limitative thereto. The lower torso pants garment of this embodiment is also directed to the leggins including back body portions 48 and 49, which are symmetrically halved from each other, and a waist part 50 in the waist portion. Moreover, the buttock darts of the aforementioned embodiment are eliminated, and the buttock portions are formed in the three-dimensional shape by the paired darts between the vicinities of the upper end edge centers of the back body portions 48 and 49 and the central lower portion of the waist part 50. As a result, it is possible to attain effects similar to those in the aforementioned embodiment and to improve a wearer's feeling of being well-held in the waist portion by using a highly tensile fabric for the waist part 50.

Figure 7:
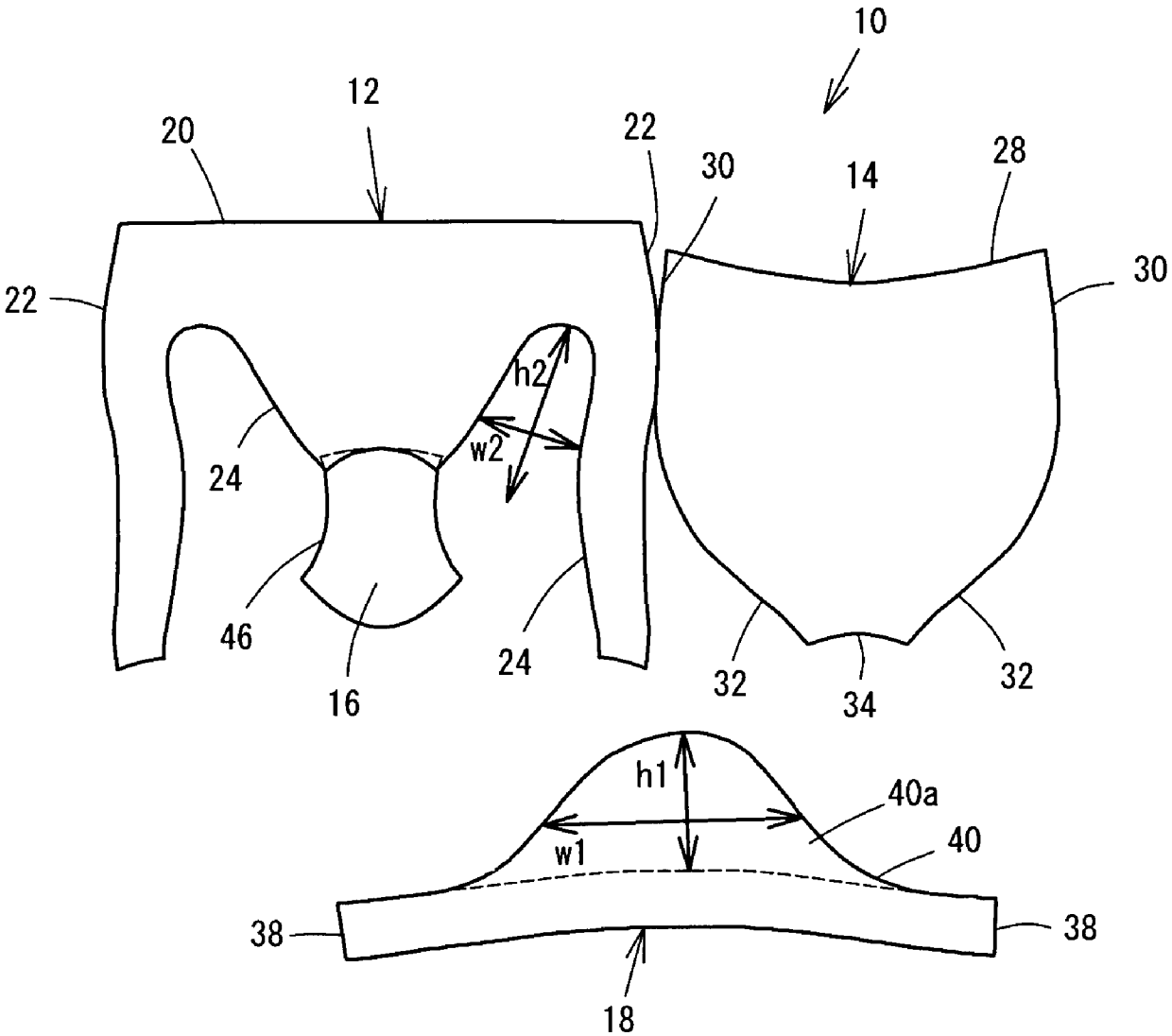
FIG. 7 is an exploded view of the individual parts of a lower torso pants garment according to still another embodiment of this invention.

As shown in FIG. 7, on the other hand, the buttock portions may also be formed in a three-dimensional shape by eliminating the aforementioned buttock darts and using the paired darts of the waist front side edges 22 and 30 between the front body portion 12 and the back body portion 14. Moreover, the hip-hold and hip-up effects can be attained by using a highly tensile material in the side edge portions of the front body portion 12.

Figure 8:
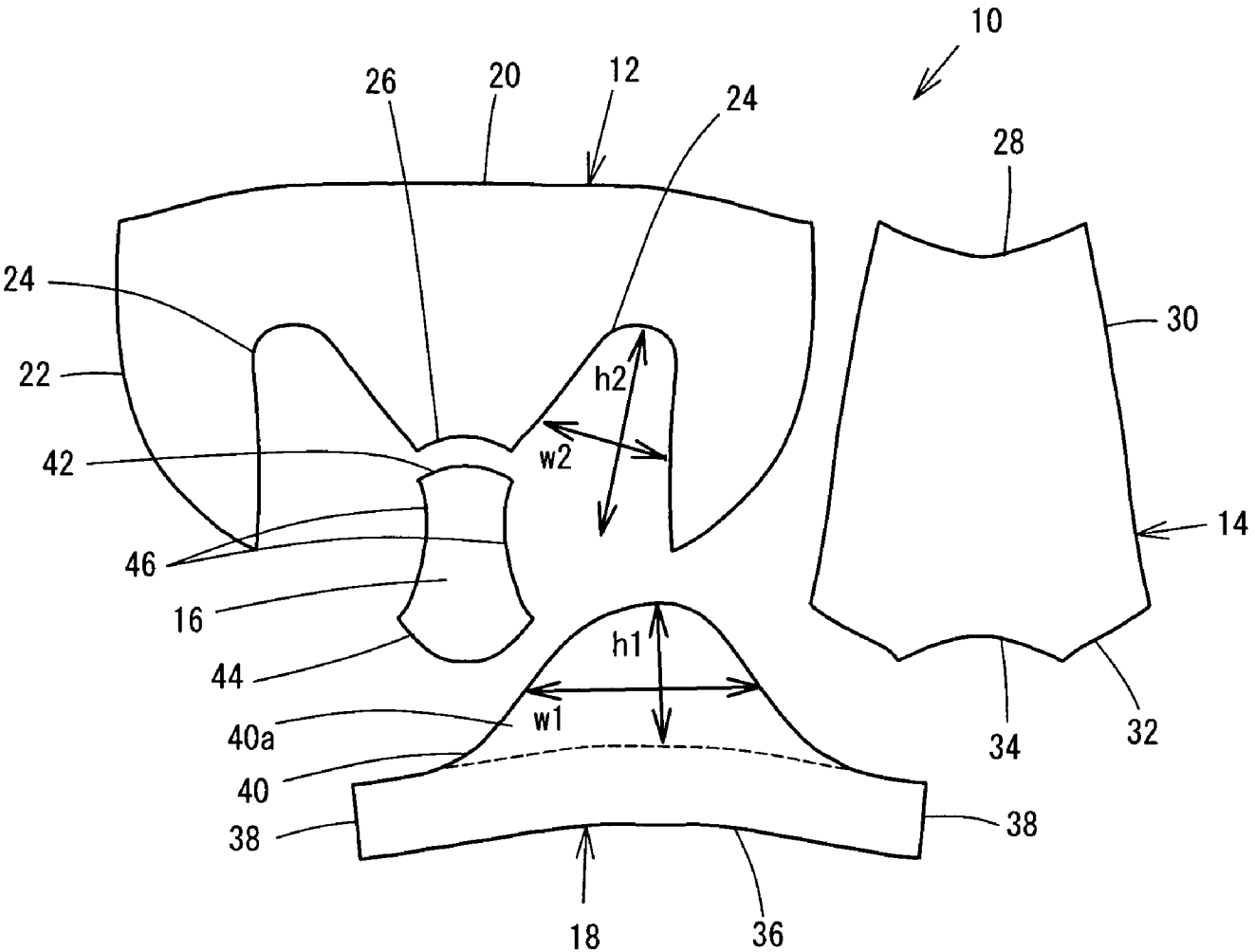
FIG. 8 is an exploded view of the individual parts of a lower torso pants garment according to a yet another embodiment of this invention.

Moreover, another embodiment may be formed in the shape as shown in the exploded view of FIG. 8. In this embodiment, the aforementioned buttock darts and waist darts are connected to form one switching line of the front body portion 12 and the back body portion 14, thereby making it possible to attain effects similar to those of the aforementioned embodiments and to impart more clearances to the buttock portions in a natural shape.

Moreover, the femoral region portion parts 18 may also be formed of one fabric in which the end edge of the hem portion 36, the shape of which is shown in FIG. 3, is employed as the axis of symmetry, the fabric being folded back on the symmetry axis of the hem portion 36. In the folded-back state, moreover, the two footed root portions 40 as the two side edge portions of the hem portion 36 may be overlapped and sewn with the leg hole forming portions 24 of the front body portion 12 and the leg hole forming portions 32 of the back body portion 14. In this case, the fabrics of the femoral region portion parts 18 overlapped are made slidable relative to each other.

As a result, even in the continuous bending and stretching exercises as shown in FIG. 5, the femoral region portion parts 18 is prevented from slipping upward of the femoral region portions, to be able to thereby provide a better feeling of wearing.

In addition, it is possible to change the hem length and the waist position and to find a variety of applications such as sportswear for use in sport events such as ball games or swimming events, or underwear. The shapes of the individual parts can also be modified according to the kinds of sports and the body shapes of wearers.

The invention claimed is:

1. A lower torso pants garment comprising: a front body portion having leg hole forming portions for curved leg holes, into which femoral region portions are inserted; a back body portion having leg hole forming portions and connected to the front body portion for covering buttock portions of a wearer and having leg hole forming portions continuing to the leg hole forming portions of the front body portion; and femoral region portion parts having a tubular shape and connected to individual leg hole forming portions of the front body portion and the back body portion for inserting the femoral region portions thereinto, wherein the leg hole forming portions of the front body portion include curved crests which are positioned near iliac spine points of the wearer whereas the leg hole forming portions of the back body portion include lower end edges which are positioned near the lower ends of the buttocks, the femoral region portion parts include crests that are smaller than curved depths of a front side of the leg hole forming portions; and widths of the crests are made larger than widths of the curved portions of the leg hole forming portions, so that the femoral region portion parts having a tubular shape when worn are shaped to protrude forward relative to the front body portion; and wherein the back body portion includes a waist portion and a crotch portion and the front body portion includes a waist portion and a crotch portion and a length of the back body portion from the waist portion to the crotch portion is made larger than a length of the front body portion from the waist portion to the crotch portion, such that tension is not applied to the back body portion when the femoral region portions of the wearer are inserted into the femoral region portion parts and said femoral region portions are protruded forward relative to the front body portion.

2. The lower torso pants garment as set forth in claim 1, wherein the leg hole forming portions are shaped such that hip hem lines are enveloped by the curved leg hole portions from the vicinities of the trochanters of the body of the wearer through vicinities of iliac spine points of the wearer to vicinities of the crotch and by curves bulging from the vicinities of the trochanters to the sides of the crotch, and such that the leg hole forming portions contact closely with the hip hem portions.

3. The lower torso pants garment as set forth in claim 1, wherein the femoral region portion parts are formed of a single fabric having two side portions and hem portions and the two side edge portions are folded back at the hem portions and connected in a laminated state over the leg hole forming portions of the front body portion and the leg hole forming portions of the back body portion, and in that overlapped fabrics of the femoral region portion parts are made slidable relative to each other.

* * * * *